US008471776B2

(12) United States Patent
Das

(10) Patent No.: US 8,471,776 B2
(45) Date of Patent: Jun. 25, 2013

(54) SLOTTED ANTENNA INCLUDING AN ARTIFICIAL DIELECTRIC SUBSTRATE WITH EMBEDDED PERIODIC CONDUCTING RINGS, FOR ACHIEVING AN IDEALLY-UNIFORM, HEMISPHERICAL RADIATION/RECEPTION WHEN USED AS A SINGLE ANTENNA ELEMENT, OR FOR AZIMUTH(ϕ)-INDEPENDENT IMPEDANCE-MATCHED ELECTRONIC BEAM SCANNING WHEN USED AS A LARGE ANTENNA ARRAY

(75) Inventor: Nirod K. Das, Ledgewood, NJ (US)

(73) Assignee: Polytechnic Institute of New York University, Brooklyn, NY (US)

( * ) Notice: Subject to any disclaimer, the term of this patent is extended or adjusted under 35 U.S.C. 154(b) by 567 days.

(21) Appl. No.: 12/649,077

(22) Filed: Dec. 29, 2009

(65) Prior Publication Data

US 2010/0201592 A1 Aug. 12, 2010

Related U.S. Application Data

(60) Provisional application No. 61/142,301, filed on Jan. 2, 2009.

(51) Int. Cl.
*H01Q 13/10* (2006.01)
*H01Q 15/02* (2006.01)

(52) U.S. Cl.
USPC ..... 343/770; 343/909

(58) Field of Classification Search
USPC ..... 343/753, 754, 909, 767, 770, 768, 343/771
See application file for complete search history.

(56) References Cited

U.S. PATENT DOCUMENTS

| | | | | |
|---|---|---|---|---|
| 7,889,127 | B2 * | 2/2011 | Sajuyigbe et al. | 342/372 |
| 2008/0117113 | A1 * | 5/2008 | Haziza | 343/786 |
| 2010/0201579 | A1 | 8/2010 | Das | |

OTHER PUBLICATIONS

Wang, Wei-Jen, "Multilayer Printed Antennas with Biaxial Anisotropic Dielectric Substrates: General Analysis and Case Studies" Dissertation, Submitted in Partial Fulfillment of the Requirements for the Degree of Doctor of Philosophy (Electrical Engineering), Polytechnic University (Jan. 2002).

U.S. Appl. No. 12/649,032, titled, "Azimuth-Independent Impedance-Matched Electronic Beam Scanning from a Large Antenna Array Including Isotropic Antenna Elements", filed Dec. 29, 2009.

* cited by examiner

*Primary Examiner* — Robert Karacsony
(74) *Attorney, Agent, or Firm* — John C. Pokotylo; Straub & Pokotylo

(57) ABSTRACT

A new antenna includes a rectangular slot element provided on a conducting plate and covered by a special substrate portion. The substrate portion includes stacked layers of capacitively-loaded conducting ring elements, arranged in the form of an (e.g., periodic) array in each layer. The slot antenna element is excited by a parallel-plate waveguide, which is fabricated below the conducting plate on which the slot antenna is made. The antenna design, when used in the form of a single antenna element, would produce ideally uniform power radiation over all directions in the upper hemispherical space. A large periodic array of such ideally isotropic antenna elements permits electronic beam scanning and has a performance of power coupling from signal sources at the antenna inputs which is independent of the azimuth (Φ) scanning direction, dependent only on one spatial variable (elevation angle, θ) of scanning. Such performance from an antenna array normally can not be achieved using conventional designs. Such an antenna array may be used in communications and radars.

8 Claims, 6 Drawing Sheets

FIGURE 2
200
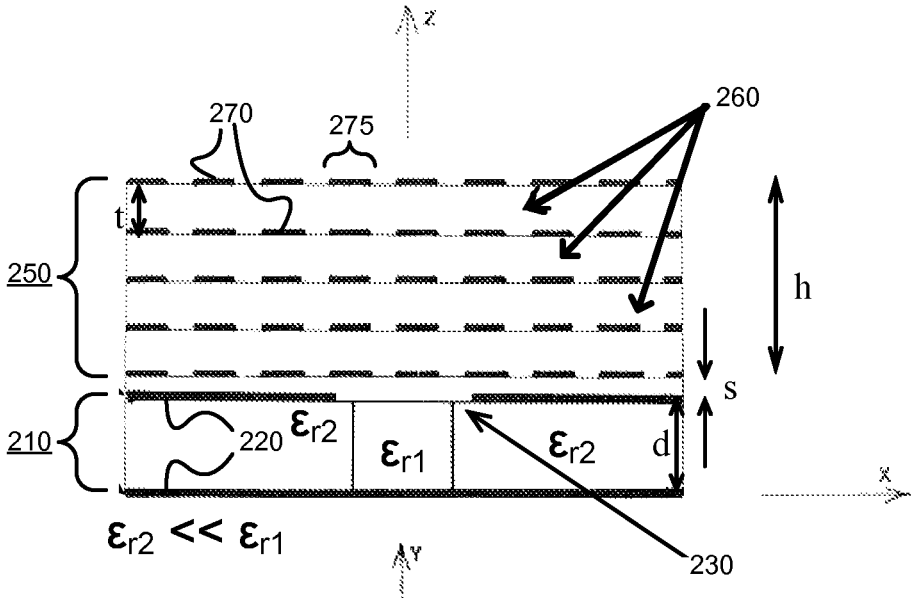
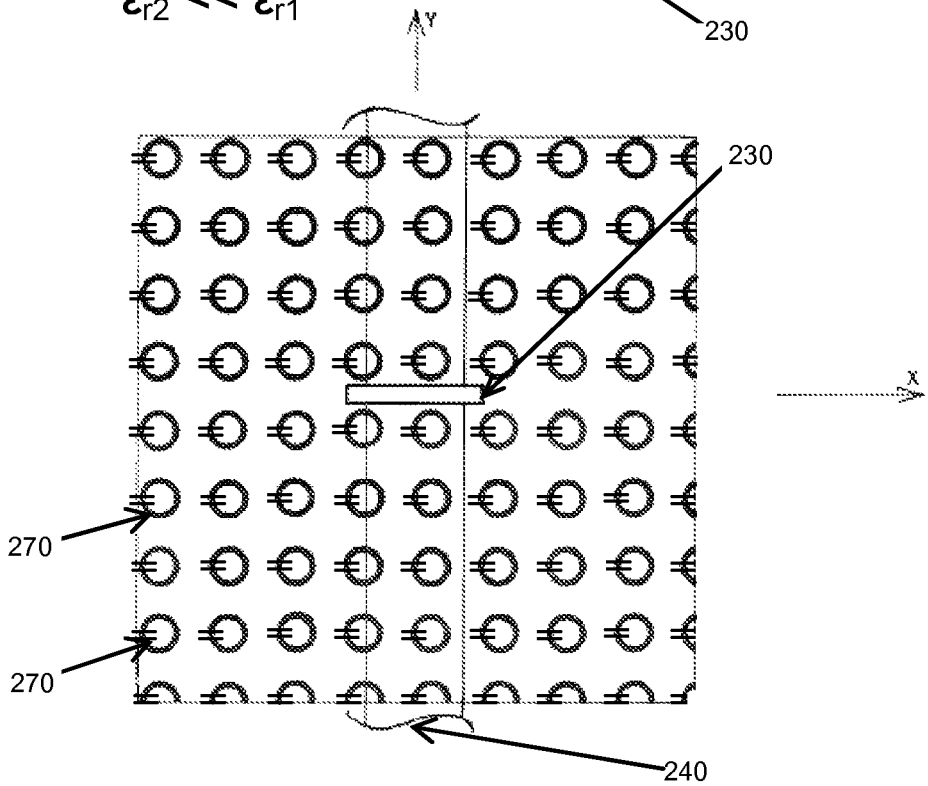
200
FIGURE 3

400

500

600

SLOTTED ANTENNA INCLUDING AN ARTIFICIAL DIELECTRIC SUBSTRATE WITH EMBEDDED PERIODIC CONDUCTING RINGS, FOR ACHIEVING AN IDEALLY-UNIFORM, HEMISPHERICAL RADIATION/RECEPTION WHEN USED AS A SINGLE ANTENNA ELEMENT, OR FOR AZIMUTH(ϕ)-INDEPENDENT IMPEDANCE-MATCHED ELECTRONIC BEAM SCANNING WHEN USED AS A LARGE ANTENNA ARRAY

§0. RELATED APPLICATIONS

Benefit is claimed, under 35 U.S.C. §119(e)(1), to the filing date of U.S. provisional patent application Ser. No. 61/142,301 (referred to as "the '301 provisional"), titled "A NEW SLOTTED ANTENNA GEOMETRY, EMPLOYING AN ARTIFICIAL DIELECTRIC SUBSTRATE ON ITS TOP WITH EMBEDDED PERIODIC CONDUCTING RINGS, FOR ACHIEVING AN IDEALLY-UNIFORM, HEMISPHERICAL RADIATION/RECEPTION WHEN USED AS A SINGLE ANTENNA ELEMENT, OR FOR AZIMUTH(ϕ)-INDEPENDENT IMPEDANCE-MATCHED ELECTRONIC BEAM SCANNING WHEN USED AS A LARGE ANTENNA ARRAY," filed on Jan. 2, 2009 and listing Nirod DAS as the inventor, for any inventions disclosed in the manner provided by 35 U.S.C. §112, ¶ 1. The '301 provisional application is expressly incorporated herein by reference. The scope of the present invention is not limited to any requirements of the specific embodiments described in the '301 provisional application.

§1. BACKGROUND OF THE INVENTION

§1.1 Field of the Invention

The present invention concerns antennas. In particular, the present invention concerns providing an improved slot antenna having a desirable radiation characteristic and an improved antenna array with simplified impedance matching.

§1.2 Background Information

Slot or aperture antennas have non-ideal radiation characteristics for various applications. Therefore, it would be useful to provide a slot antenna with an improved radiation characteristic, such as an isotropic or substantially isotropic radiation characteristic in a hemispherical space, with no radiation in the other half space.

Further, the scanning performance of a large planar antenna array normally depends on both the elevation angle (θ) and the azimuth angle (ϕ). This makes it practically very difficult to "match" its electronic feeding circuits in order to perform in a desired manner for scanning in all directions in θ and ϕ. There are simply too many directions in a 3D space for complex circuit optimizations to be implemented. Therefore, it would be useful to simplify the optimization of antenna arrays.

§2. SUMMARY OF THE INVENTION

Embodiments consistent with the present invention can be used to meet at least some of the foregoing needs by providing a slot antenna with an improved radiation characteristic, such as an ideally isotropic, or substantially isotropic, radiation characteristic in a hemispherical space, with no radiation in the other half space. Embodiments consistent with the present invention can be used to meet at least some of the foregoing needs by providing a slot antenna including (a) a slot antenna portion including a dielectric waveguide defined by parallel plates and provided with a slot, and (b) a substrate portion provided above the slot antenna portion including a low dielectric constant material provided with a matrix of conducting capacitive ring elements.

Embodiments consistent with the present invention can be used to meet at least some of the foregoing needs by providing a large periodic array of ideally isotropic, or substantially isotropic, antenna elements to permit electronic beam scanning (also referred to as "steering") while permitting performance of power coupling from signal sources at the antenna inputs to be optimized in a manner which is independent of the azimuth (Φ) scanning direction (dependent only on one spatial variable (elevation angle, θ) of scanning). Such embodiments might do so by providing a system including (a) an array of slot antenna elements, (b) a control circuit for steering the slot antenna elements over a first range of elevation angles and a second range of azimuth angles, (c) at least one substrate, including a matrix of conducting capacitive ring element stacks, arranged adjacent to the array of slot antenna elements such that each of the slot antenna elements has a substantially isotropic radiation characteristic in a hemispherical space, and (d) for each of the slot antenna elements of the array, a power coupling module adapted to match a conductance of the slot antenna element to a source conductance of a signal source, as a function of a current elevation angle, but independent of a current azimuth angle.

§3. BRIEF DESCRIPTION OF THE DRAWINGS

FIG. 2 is a cross-sectional side view of an improved slot antenna consistent with the present invention.

FIG. 3 is a plan view of an improved slot antenna consistent with the present invention.

§4. DETAILED DESCRIPTION

The present invention may involve improved slot antennas, as well as antenna arrays including such improved slot antennas. The following description is presented to enable one skilled in the art to make and use the invention, and is provided in the context of particular applications and their requirements. Thus, the following description of embodiments consistent with the present invention provides illustration and description, but is not intended to be exhaustive or to limit the present invention to the precise form disclosed. Various modifications to the disclosed embodiments will be apparent to those skilled in the art, and the general principles set forth below may be applied to other embodiments and applications. For example, although a series of acts may be described with reference to a flow diagram, the order of acts may differ in other implementations when the performance of one act is not dependent on the completion of another act. Further, non-dependent acts may be performed in parallel. Also, as used herein, the article "a" is intended to include one or more items. Where only one item is intended, the term "one" or similar language is used. In the following, "information" may refer to the actual information, or a pointer to, identifier of, or location of such information. No element, act or instruction used in the description should be construed as critical or essential to the present invention unless explicitly described as such. Thus, the present invention is not intended to be limited to the embodiments shown and the inventor regards his invention to include any patentable subject matter described.

§4.1 EXEMPLARY SYSTEM IN WHICH AN ANTENNA ARRAY CONSISTENT WITH THE PRESENT INVENTION MAY BE USED

Figure 1:
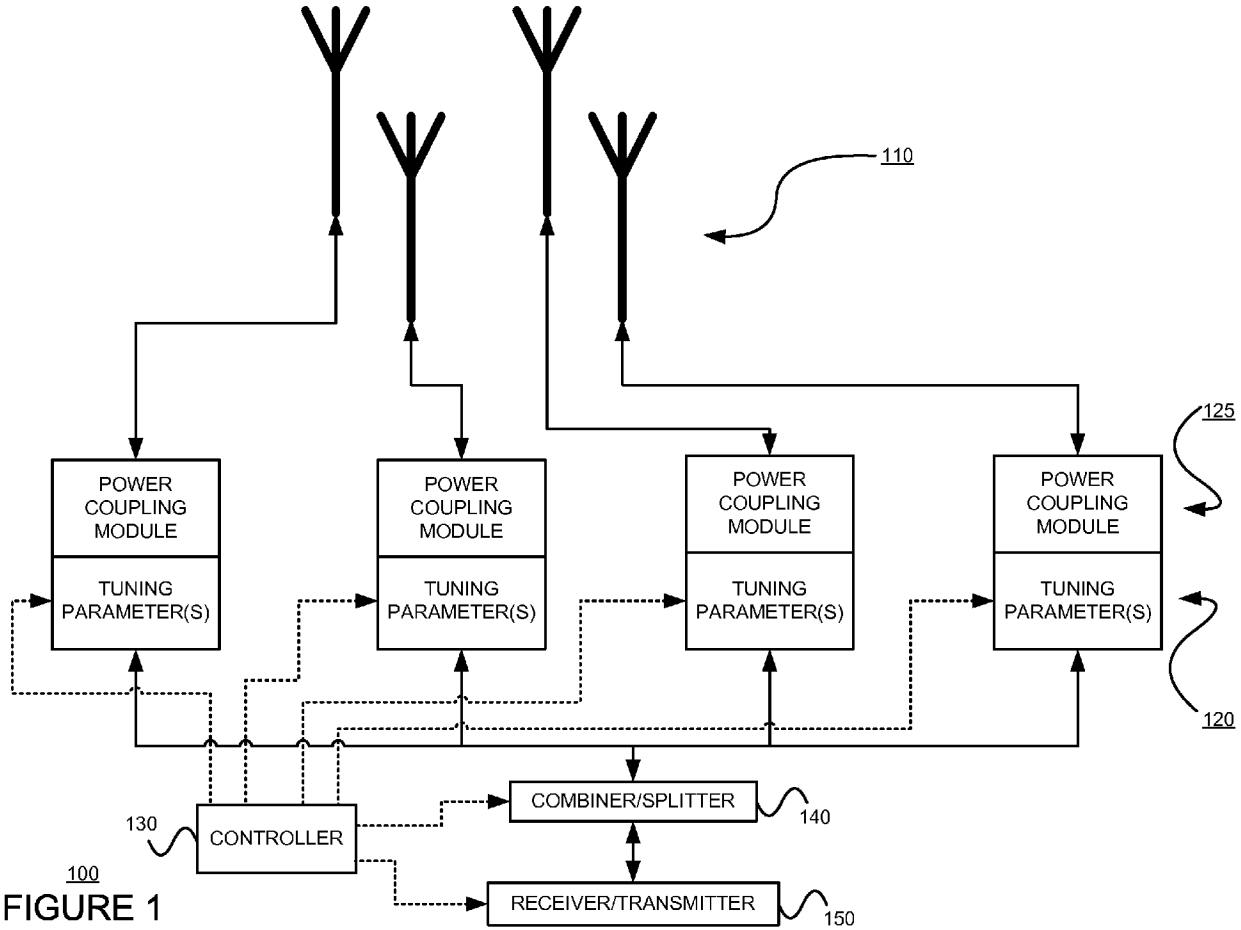
FIG. 1 illustrates elements of a system in which an antenna array consistent with the present invention may be used.

FIG. 1 illustrates elements of a system 100 in which an antenna array consistent with the present invention may be used. The system 100 may include an array of antennas 110, each of the antennas 110 being associated with tuning parameter(s) (e.g., a time delay or phase shift) 120 and a power coupling (e.g., matching) module 125. A controller 130 may be used to set and/or control the tuning parameter(s) 120 and may control a combiner and/or splitter 140, and a receiver and/or transmitter 150. For example, the controller might provide radiation steering control, parameter tuning, etc. Signals received by the antennas 110 may be coupled with a combiner 140, which provides a combined signal to the receiver 150. A transmitter 150 may provide a signal to the splitter 140, which sends separate signals to the antennas 110.

As discussed above, typically, the scanning performance of a large planar antenna array 110 depends strongly on both the azimuth ($\Phi$) and elevation ($\theta$) directions of scanning. However, this makes it practically difficult to "match" its electronic circuits (in power coupling modules 125) in order to perform in a desired manner for scanning in all directions in $\Phi$ and $\theta$. In embodiments consistent with the present invention, improved slot antennas, having an ideally isotropic, or substantially isotropic, radiation characteristic in a hemisphere, are used as the antennas to simplify the task of "matching" their circuits (in power coupling modules 125) for scanning in all directions.

§4.2 EXEMPLARY IMPROVED SLOT ANTENNAS

FIG. 2 is a cross-sectional side view of an improved slot antenna 200, consistent with the present invention. FIG. 3 is a plan view of the improved slot antenna 200 of FIG. 2. The improved slot antenna of FIGS. 2 and 3 includes a rectangular slot antenna portion 210 arranged below a substrate 250. The substrate 250 may be spaced a distance "s" from the slot antenna portion 210. The rectangular slot antenna portion 210 includes parallel ground plates 220 (spaced a distance "d" apart) and a dielectric waveguide feed 240 provided with a slot 230. The substrate portion 250 is made of a low-dielectric-constant material (such as polymer-based foam, for example, with $\in\approx 1$) 260 within which capacitively-loaded conducting ring elements 270 are (e.g., periodically) arranged. The ring elements 270 are arranged spaced and arranged coaxially in "stacks" 275. The substrate portion 250 may have a height "h" of approximately one quarter of the free-space wavelength $\lambda_0$ of the radiation provided in the dielectric waveguide feed 240. The spacing "s" should be much less than the height "h". Note that the dielectric constant $\in_{r2} << \in_{r1}$.

Each ring element 270 is made adequately small in size, compared to the wavelength ($R << \lambda_0$). The ring elements 270 are periodically spaced as close as possible, and are stacked in multiple layers with layer-to-layer separation as close as possible. The goal is to have the substrate 270 behave as an ideal, uniform material medium. The arrangement of ring elements 270 may be referred to as a matrix or three-dimensional matrix of ring elements.

Figure 4:
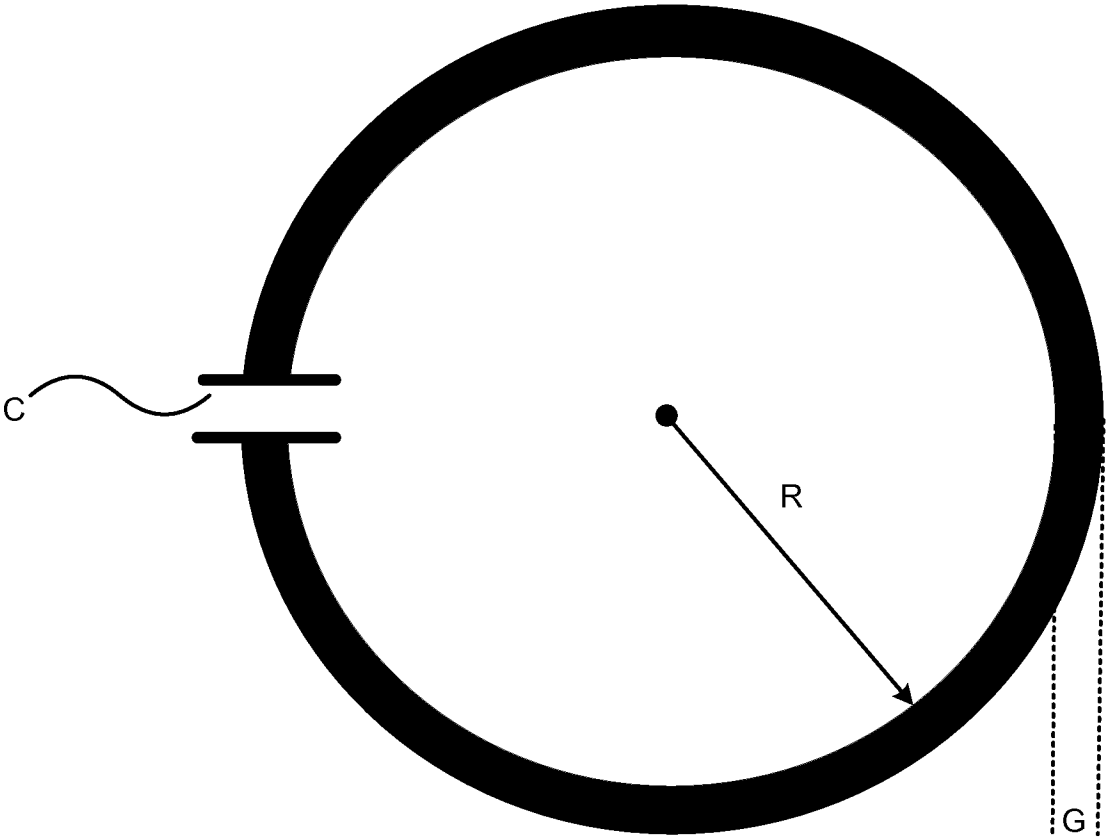
FIG. 4 illustrates a capacitive ring element which may be used in the improved slot antenna of FIGS. 2 and 3.

The geometry of each ring element 270 is shown separately in FIG. 4. The letter R denotes the radius of the ring element 270, C denotes the capacitance of the ring element 270 and G denotes the width (or gauge) of the ring element 270. The capacitor portion of each ring element 270 might be defined by an external capacitor electrically coupled with the ring element. Alternatively, or in addition, the capacitor portion of each ring element might be defined by a gap in the material of the ring element itself, with the gap being filled with air or some other dielectric material. The capacitance C is adjusted to tune with the effective inductance seen at the input of each ring, such that the resulting wave propagation constant $k_z$ in the normal (z) direction is about equal to the free-space propagation constant $k_0$, and the effective transverse impedance of the medium is equal to the free-space wave impedance $\eta_0$.

Practical manufacturing of the artificial substrate would deviate from the ideal performance. However, such deviations are expected to be negligible for operating frequencies where the ring separation, diameter, and layer thickness are much smaller than the operating wavelength. Above dimensions that are one-hundredth or less than wavelength $\lambda_0$ would be considered practically small for practically ideal designs. Dimensions somewhat larger than the above prescribed range are still expected to provide acceptable practical performance.

An antenna 200 consistent with FIGS. 2 and 3 would basically produce an isotropic power pattern along all directions in a 3-D hemispherical space above the antenna 200. The radiation is blocked by the parallel-plate 220 structure below the antenna element, which serves as the feeding circuit. A parallel-plate dielectric waveguide ("PPDW") 240 is used for feeding radiation to the slot 230. The PPDW structure 240 allows efficient feeding of the slot 230, with negligible power escaping from the slot 230 in the form of unwanted lateral radiation into the parallel-plate 220 structure. Most radiation from the slot 230 is reflected from the sidewalls of the PPDW 240 feed through total internal reflection. The dimensions (thickness and width) and material parameters of the PPDW feed are adjusted for proper impedance matching with the slot antenna and power efficiency of the feeding.

§4.2.1 Technical Concept of the Improved Antenna Element

§4.2.1.1 The Substrate

A substrate 250 in which metal rings 270 are aligned parallel to the substrate interface layer, would affect any field which originally has a non-zero normal (z) component of the magnetic field. If the field has no magnetic field in the normal direction, with all its magnetic fields along the transverse (x and y) directions, it would be ideally unaffected while passing through the substrate 250. Now, the radiation from a slot antenna 230 may be completely decomposed into two parts: TE-to-z (transverse electric to z) radiation; and TM-to-z (transverse magnetic to z) radiation. The TM-to-z radiation has magnetic fields transverse or normal to z, and is therefore unaffected by the artificial substrate. The TE-to-z radiation has its electric fields transverse to the z direction, while the magnetic field in general has a component along z. Accordingly, the TE-to-z radiation is strongly affected by presence of the ring elements 270 in the substrate 250. The propagation of the TE-to-z radiation in the substrate 250 may be modeled as follows.

Any magnetic field directed in the horizontal (x-y) plane does not induce any current in the ring elements 270 and therefore "sees" only the foam medium 260, with its magnetic permeability close to that of the free space. On the other hand, a z-directed magnetic field would strongly induce currents in the ring elements 270, which would then produce additional new magnetic fields. These new magnetic fields would be mostly along the z direction, when the ring elements 270 are closely stacked, aligned on top of each other. The resulting effects may be modeled by treating the substrate 250 as a uniaxial magnetic material. The magnetic permeability in the horizontal (x-y) plane is equal to that in a free-space medium. On the other hand, the magnetic permeability in the normal (z) direction may be considered a variable parameter, which can be adjusted to fit the required propagation and impedance characteristics of the substrate 250. This would be determined by the parameters of the ring element 270, the distribution of the ring element array, and the value of the capacitive loading.

Based on this uniaxial behavior, it can be shown that the equivalent propagation constant of the artificial medium for a TE-to-z wave would be equal to the free-space propagation constant, independent of the propagation direction, when the axial permeability in the z direction is ideally infinity, or very high. Conversely, if the propagation constant of the artificial structure is computed to be close to the free-space propagation constant, for all spatial directions of propagation, then the uniaxial permeability of the artificial medium can be set to be infinity for the purposes of further design analysis. In this case, it can be shown that the equivalent transverse impedance for the TE-to-z wave would be equal to the wave impedance in the free space, and is independent of the propagation direction of the TE-to-z radiation.

With a suitable adjustment of parameters of the ring elements 270, array dimensions, layer-to-layer separation, and the capacitive loading, the propagation constant of the foam medium 260 is designed to be equal to that in the free space. In this case, as per the above design theory, the equivalent impedance of the substrate 250 for the TE-to-z wave would be equal to the wave impedance of the free space ($\eta_0$), ideally independent of the angle of propagation of the TE-to-z wave. The equivalent propagation and impedance properties of the substrate 250, so designed, will be used in determining the radiation performance of the slot antenna 230 in the presence of the substrate 250.

§4.2.1.2 Antenna in the Presence of the Substrate

The total radiation from the slot antenna 230 in the presence of the substrate 250 is now considered. The radiation performance is described using TE and TM wave decomposition, and using equivalent admittance modeling for each case. This is a standard technique used for modeling planar slot antennas. Admittance modeling is suitable for a slot antenna source, which is modeled as an equivalent magnetic current source. (This is in contrast to a dipole current source, which is instead modeled using an equivalent impedance approach.) Consider the TE-to-z radiation from the slot 230 in the presence of the substrate 250. Let the equivalent input admittance in this case be equal to $Y_{in,TE}$. This TE input admittance $Y_{in,TE}$ can be shown to be equal to $Y_{air,TM}$, which is the admittance seen by a TM-to-z wave in an air or a free-space medium, without any covering substrate. This can be proven by considering the artificial substrate medium to operate as a quarter-wave transformer, which transforms the TE-to-z admittance $Y_{air,TE}$ of the free-space or air medium at the top layer to the TM-to-z admittance $Y_{air,TM}$, as derived below. This useful transformation is possible because the TE-to-z admittance $T_{substrate,TE}$ of the substrate 250 is equal to the wave admittance $\eta_0$ of the free space, independent of the propagation angle $\theta$, as discussed above.

$$Y_{air,TE} = \cos\theta/\eta_0,\ Y_{substrate,TE} = 1/\eta_0 \tag{2a}$$

$$Y_{in,TE} = \frac{(Y_{substrate,TE})^2}{Y_{air,TE}} = \frac{1}{\eta_0\cos\theta} = Y_{air,TM} \tag{2b}$$

As derived above, interestingly the TE-to-z wave in the presence of the substrate 250 is equivalently "seen" by the slot 230 as if it is a TM-to-z wave in the free space. The TM-to-z wave in the presence of the substrate 250 is also seen by the slot 230 as if it is a TM-to-z wave in the free space. Therefore, the slot 230 would see the total radiation (TE plus TM waves) in the presence of the substrate 250 as if it sees the free space for a purely TM-to-z radiation. In other words, the total input admittance $Y_{in}$ seen by the slot 230, in the presence of the substrate 250, is equal to the TM-to-z admittance of the air or free space medium, without any substrate.

$$Y_{in} = Y_{air,TM} = \frac{1}{\eta_0\cos\theta} \tag{3}$$

The radiation pattern of the slot 230 is known to be proportional to the product of three factors: (i) the total equivalent admittance $Y_{in}$ seen by the slot source; (ii) the source transform as a function of the wave numbers on the transverse plane (or equivalently the radiation angles $\theta$ and $\phi$); and (iii) an additional cos $\theta$ factor. The cos $\theta$ factor relates the density of the power flow in the normal direction, which is characterized by the transverse equivalent modeling, to that in a particular radiation direction. If the slot 230 is electrically small as compared to the wavelength $\lambda_0$, the source distribution may be approximated as a delta function, whose transform is a constant, independent of the transform parameters or radiation directions. In this case, as per the above principle, the power radiation pattern would be proportional to cos $\theta$ $Y_{in}$, which is independent of both $\theta$ and $\phi$ angles, as demonstrated here:

$$\cos\theta Y_{in} = \cos\theta\frac{1}{\eta_0\cos\theta} = \frac{1}{\eta_0} \tag{4}$$

As mentioned, the above performance assumes that the slot 230 is small, with a source transform which is constant over all wave numbers or spatial directions. In this case the radiation pattern is ideally determined only by the impedance characteristics of the medium. In practical situations when the slot 230 has a non-zero length, there would be some deviations from the ideal isotropic nature of the radiation power pattern. If the slot 230 is designed, with its length which is a reasonably small fraction of the wavelength $\lambda_0$ (e.g., on the order of $0.1\lambda_0$), the resulting radiation pattern would be practically close to an isotropic pattern.

§4.3 EXEMPLARY ANTENNA ARRAY INCLUDING IMPROVED SLOT ANTENNAS

Figure 5:
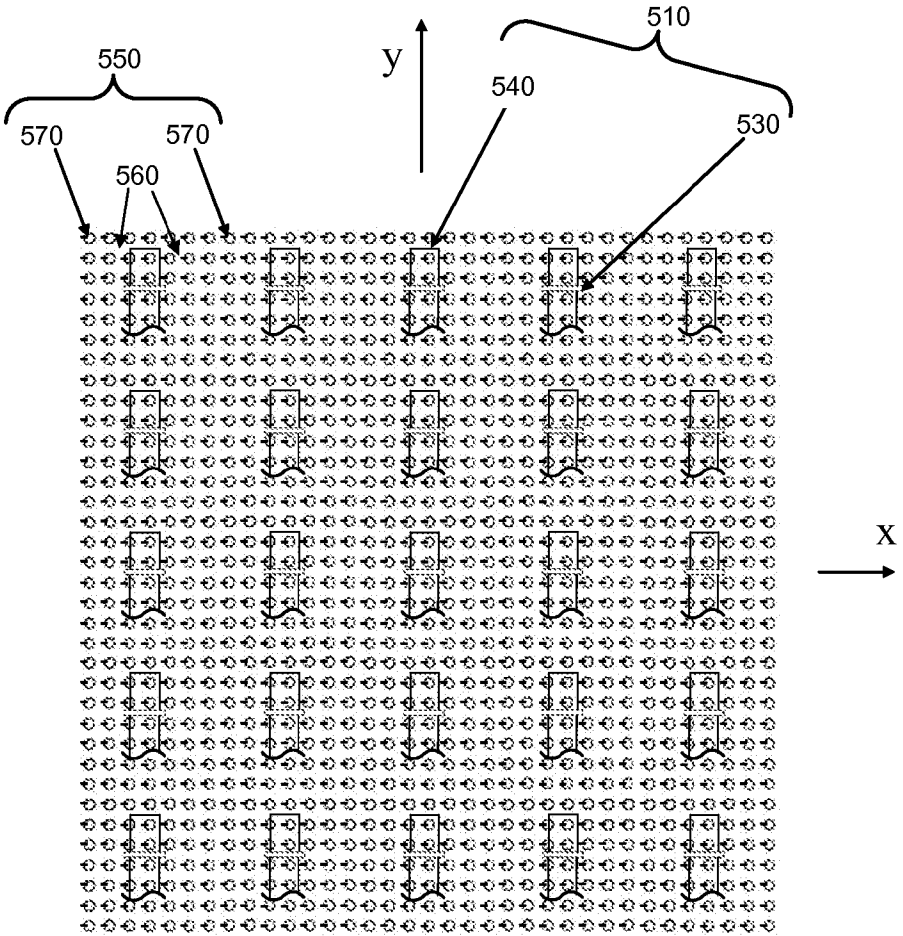
FIG. 5 is a plan view of an array of improved slot antennas consistent with the present invention.

FIG. 5 is a plan view of an array of slot antennas 510, each including a dielectric waveguide 540 and a slot 530, provided below a substrate 550 including ring elements 570 in a foam medium 560, consistent with the present invention. More specifically, FIG. 5 is a plan view of an arrangement of an array of slot antennas 510, printed on the XY plane, below a substrate 550. This array geometry is useful for antenna beam steering. The array can be designed advantageously with a scanning impedance which is independent of the scanning direction in any azimuthal plane. Further, with proper impedance matching, the array can be scanned efficiently over a side range of solid angles.

The input impedance seen at each slot antenna element 510 may also be modeled using the transverse admittance technique used to characterize an isolated element. The periodic array may be considered as a superposition of Floquet modes. The equivalent admittance $Y_{in}=Y_{air,TM}=1/(\eta_0 \cos\theta)$ of equation (3) would be seen by the dominant Floquet mode of the array. This admittance is independent of the $\phi$ angle of antenna scanning. The impedance at the input of each antenna element 510 of the array is mostly determined by the impedance seen by the dominant Floquet mode. Thus, the impedance at the input of each slot antenna element 510 of the array is essentially independent of the scan angle $\phi$. Accordingly, the array would be able to couple source power to each slot antenna element 510 equally well in all values of scan angle $\phi$. However, the impedance still depends on the $\theta$ value of the scan direction. In other words, the scanning performance of the antenna array is essentially a function of one angle variable, $\theta$. If the array is designed for scanning along one particular value of $\phi$, the design would work equally well for all $\phi$ values.

Practical techniques do exist to optimally match antenna arrays for scanning in one given $\phi$ plane (or possibly in only a few selected $\phi$ planes). This is possible by using matching circuits that may be dynamically tuned or switched to match the varying array impedance to a given source, as the array is scanned in different elevation angles $\theta$. Other advanced techniques may also be employed to this end, by using a matching cover layer, made of a regular dielectric material, on top of the antenna, or by using novel feeding arrangements by cross-connecting feeds of different array elements. However, for conventional planar antenna arrays, such matching techniques do not generally work for all other $\phi$ planes of scanning. The array's input impedance for a conventional design, unlike in embodiments consistent with the present invention, is different in different $\phi$ planes. Therefore, in such conventional designs, the variable impedance in different $\phi$ planes of scanning would no longer match as well to a given source impedance, which is originally designed to match to the array impedance at a given $\phi$ plane.

The above problem is clearly overcome with an array consistent with the present invention because if improved slot antenna elements are used, any conventional matching technique designed for one $\phi$ plane would work perfectly well for all other $\phi$ values of scan direction. This is because the array input impedance is independent of the $\phi$ angle of scanning. This is a significant advantage which should facilitate development of technology for array scanning in three dimensions.

§4.4 REFINEMENTS, EXTENSIONS AND ALTERNATIVES

Referring back to the power coupling modules 125 of FIG. 1, the equivalent admittance, $Y_{in}=G_{in}+jB_{in}$, seen at the input of each element 110/200/510 of an antenna array 500 is, in general, dependent on both the angles $\theta$ and $\phi$, along which the array is to be steered. As the array is electronically steered by changing the phase of the input signals to the elements (e.g., by controller 130), the mutual interaction between all the antenna elements 110/200/510 changes with the signal phase, resulting in a variable input admittance with the angle of steering.

$$Y_{in}(\theta,\phi)=G_{in}(\theta,\phi)+jB_{in}(\theta,\phi) \tag{5}$$

For an ideal periodic antenna array with infinite number of antenna elements, the input admittance would be equal for each antenna element. This is because the infinite periodic environment would look the same to each antenna element. However, in a finite-sized array 500, the antenna elements 110/200/510 placed towards the edge of the array 500 would see a somewhat different environment, as compared to an antenna element 110/200/510 in the center of the array 500. This would result in the input admittance of the edge elements deviating from that of the center elements. It may be assumed that such deviations from element to element are practically small.

As the antenna array is electronically steered in a different direction, the signal source at the input of each antenna element 110/200/510 would see a varying load admittance. Accordingly, the matching condition seen by each input source would change with the steering angle. Therefore, if the source was matched for optimum power radiation at a particular direction of scanning, the matching condition would become invalid as the array is steered to a different direction. Thus, the matching might have to be circuit tuned again for the new direction of scanning. However, in a conventional array design, where the input admittance is a general function of the elevation and azimuth angles, the array has to be rematched at a large number of scanning directions, requiring prohibitively complex circuitry in terms of space or cost of fabrication. This is probably the most critical issue faced in the design of scanning antennas today, which limits common designs to scanning over only a limited angular space.

The slot antenna 200 of FIGS. 2 and 3 is a special radiating element, which produces (near) ideal, isotropic radiation in all directions of a hemisphere. The admittance behavior of the particular slot antenna element 510 when used in a large-array environment 500 is considered. In such an environment, particularly when the antenna slot length is sufficiently small compared to wavelength, and the array elements are spaced less than a half-wavelength apart, the antenna input admittance $Y_{in}$ is found to have the following special behavior. The suceptance part $B_{in}$ is independent of the scan angles ($\theta$, $\phi$), when the antenna element 110/200/510 separation ideally approaches zero. Fortunately, however, there is only minimal variation of the suceptance part $B_{in}$ as a function of the scan angles ($\theta$, $\phi$) when the antenna elements 110/200/510 are separated up to a half-wavelength.

The real part $G_{in}$ of the input admittance $Y_{in}$ is independent of the azimuth angle $\phi$ and is a function of only the elevation angle $\theta$. Therefore, such antenna admittance characteristics, together with the antenna's isotropic radiation, can be advantageously used for a novel array design.

$$G_{in}(\theta,\phi)=G_{in}(\theta), B_{in}(\theta,\phi)\approx B_{in}, Y_{in}(\theta,\phi)=G_{in}(\theta)+jB_{in} \tag{6}$$

Thus, an antenna array 500 consistent with the present invention can radiate in all directions, and can therefore "see" in all directions without any "blind" angles. In addition, its input admittance can be conveniently matched to the input source as described in the following, allowing maximum power delivered in any given direction when the array is used as a transmitter, or maximum power extracted from any given direction when used as a receiver.

Figure 6:
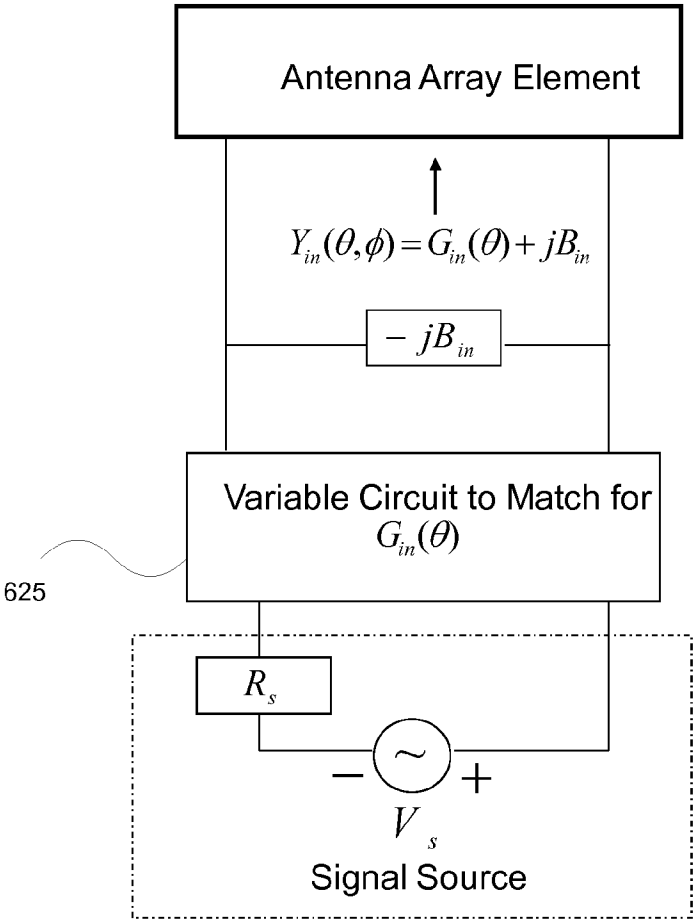
FIG. 6 illustrates a variable matching circuit for an antenna array with input impedance $R_{in}(\theta)$.

Therefore, as illustrated in FIG. 6, a variable matching circuit 625 may be designed, which can now be conveniently adjusted only for the elevation scan angle 0°θ<90°. Referring back to FIG. 1, such a variable matching circuit may be provided in (or as) the power coupling modules 125.

With the foregoing in mind, one skilled in the art can design matching circuits for various antenna arrays consistent with the present invention. Matching circuits are discussed in the text *Microwave Engineering*, by David Pozar (Addision Wesley, ISBN 0-201-50418-9)(incorporated herein by reference).

Referring back to FIG. 5, antenna elements 510 may be slot radiators (L×W), with a dielectric waveguide feed (width=b). The ring elements may have a radius R and a periodicity of a×a.

§4.5 EXEMPLARY METHODS

Figure 7:
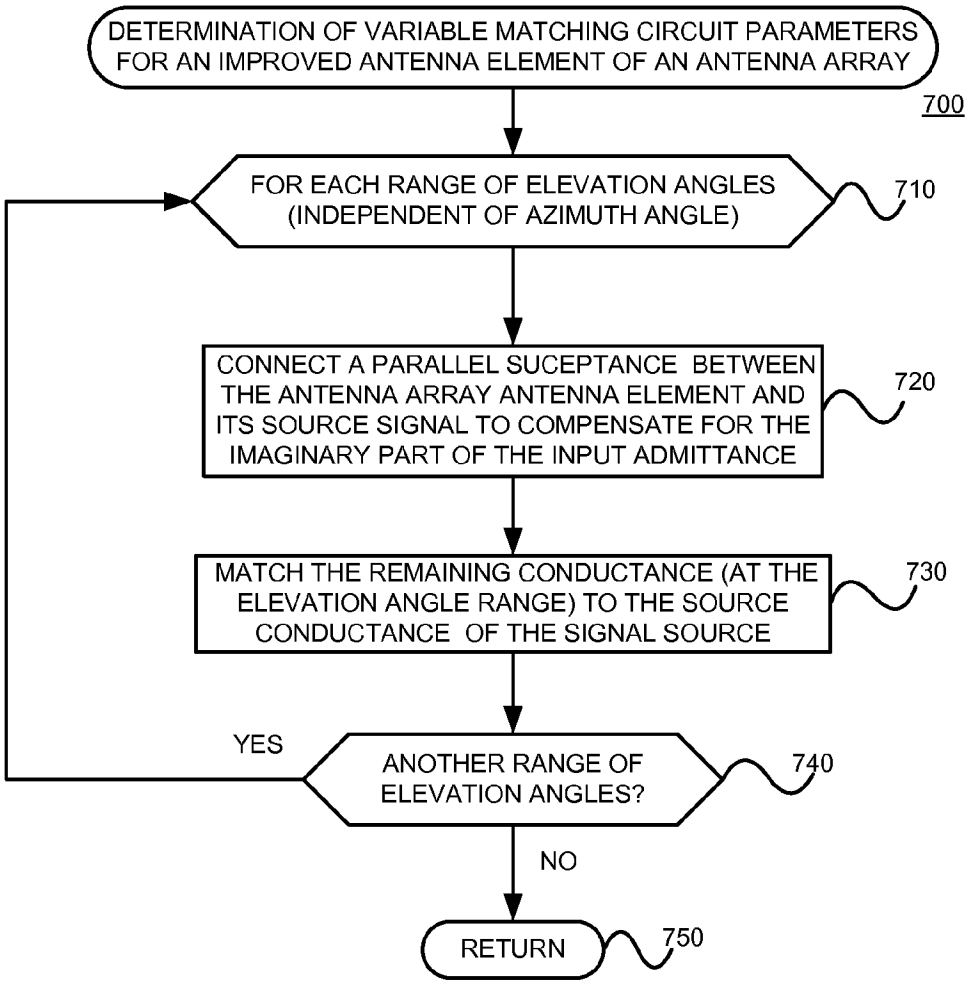
FIG. 7 is a flow diagram of an exemplary method for determining variable matching circuit parameters for an improved antenna element of an antenna array consistent with the present invention.

FIG. 7 is a flow diagram of an exemplary method 700 for determining variable matching circuit parameters for an improved antenna element of an antenna array consistent with the present invention. For each of a plurality of ranges of elevation angles, certain acts are performed. (See loop 710-740.) More specifically, a parallel suceptance (which is negative $B_{in}$) is connected between the antenna array element and its signal source. (Block 720) The remaining conductance (at the elevation angle range) is then matched to the source conductance of the signal source. (Block 730). When all of the plurality of ranges of elevation angles have been processed, the method is left. (Node 750)

The method 700 may be performed for each antenna element of the antenna array.

In some embodiments consistent with the present invention, it may be assumed that the conductance varies monotonically with the inverse of the cosine of the elevation angle (θ).

Note that method 700 may operate without consideration of the azimuth angle (Φ).

Referring back to loop 710-740, the entire range of elevation angles may be divided into a finite number of segments N, depending on the performance accuracy desired. Consequently, the variable matching circuit would need only N sets of variables to work for the different segments corresponding to different ranges of elevation angles. Only a handful of elevation segments N might be sufficient to cover the entire space with acceptable performance.

Further, the conductance $G_{in}(\theta)$ varies monotonically with the inverse of cos θ. Such orderly, monotonic variation of impedance with scan angle θ is also a special characteristic, distinct from other conventional planar antennas. This feature can be used to simplify matching design or tuning arrangement.

As should be appreciated from the foregoing, the imaginary part of the input admittance may be compensated by connecting a parallel suceptance (which is negative $B_{in}$). The remaining conductance $G_{in}(\theta)$ is then matched to the source conductance $G_s=1/R_s$ of the signal source, using a suitable matching circuit. Since the input conductance is independent of the azimuth angle ϕ, any matching circuit which works for a given ϕ, would work equally well for all ϕ. Therefore, as illustrated in FIG. 6, a variable matching circuit 625 may be designed, which can now be conveniently adjusted only for the elevation scan angle 0°<θ<90°. Referring back to FIG. 1, such a variable matching circuit may be provided in (or as) the power coupling modules 125.

As mentioned, the above special characteristics would not have been possible for array designs using conventional antenna elements. Therefore, the new array design would provide significant performance improvement over conventional arrays, allowing development of much advanced wireless communication or radar systems.

§4.6 CONCLUSIONS

As should be appreciated from the foregoing, a slot antenna consistent with the present invention can achieve a power radiation (and reception) pattern, which is ideally isotropic, or substantially isotropic, in all directions in a hemispherical space, with no radiation in the other half space. Such an isotropic radiation pattern cannot be achieved using conventional designs, which is often considered a fundamental constraint in basic antenna theory.

As should be appreciated from the foregoing, some embodiments consistent with the present invention provide an improved slot antenna with a substantially isotropic radiation characteristic above the slot. Further, embodiments consistent with the present invention permit electronic beam scanning (also referred to as "steering") while permitting performance of power coupling from signal sources at the antenna inputs to be optimized in a manner which is independent of the azimuth (Φ) scanning direction (dependent only on one spatial variable (elevation angle, θ) of scanning).

What is claimed is:

1. A slot antenna comprising:

a) a slot antenna portion including a dielectric waveguide defined by parallel plates and provided with a slot; and b) a substrate portion provided above the slot antenna portion, and including a low dielectric constant material provided with a matrix of conducting capacitive ring elements, wherein the substrate portion has a height h which is approximately one quarter of a free-space wavelength for the frequency of radiation provided in the input dielectric waveguide, and wherein the substrate portion is spaced from the slot antenna portion with a spacing s which is much less than the height h, and wherein the slot antenna, when used as a single antenna element, has a uniform, hemispherical radiation and reception characteristic such that the radiation and reception characteristic is isotropic or substantially isotropic in a hemispherical space, with substantially no radiation in a complementary hemispherical space.

2. The slot antenna of claim 1 wherein the matrix of conducting capacitive ring elements includes spaced co-axial stacks of conducting capacitive ring elements, and each of the co-axial stacks including a plurality of conducting capacitive ring elements having a spacing of t.

3. The slot antenna of claim 1 wherein the substrate portion is made from a polymer-based foam.

4. The slot antenna of claim 1 wherein the substrate portion has a dielectric constant on the order of 1.

5. The slot antenna of claim 1 wherein the matrix of conducting capacitive ring elements is arranged coaxially in stacks.

6. A system comprising:

a) an array of slot antenna elements;

b) a control circuit for steering the slot antenna elements over a first range of elevation angles and a second range of azimuth angles;

c) at least one substrate, including a matrix of conducting capacitive ring element stacks, arranged adjacent to the array of slot antenna elements wherein a height h of the at least one substrate is approximately one quarter of a free-space wavelength for the frequency of radiation provided in the dielectric waveguide inputs to the slot antenna elements such that each of the slot antenna elements has a substantially isotropic radiation characteristic in a hemispherical space; and wherein the substrate portion is spaced from the slot antenna portion with a spacing s which is much less than the height h, and d) for each of the slot antenna elements of the array, a power coupling module adapted to match a conductance of the slot antenna element to a source conductance of a signal source, as a function of a current elevation angle, but independent of a current azimuth angle.

7. The system of claim 6 wherein each of the at least one substrate is made from a polymer-based foam.

8. The system of claim 6 wherein each of the at least one substrate has a dielectric constant on the order of 1.

* * * * *